US007954441B2

(12) United States Patent
Stutznäcker et al.

(10) Patent No.: US 7,954,441 B2
(45) Date of Patent: Jun. 7, 2011

(54) METHOD FOR PRODUCING LARGE AREA SEWING PRODUCTS

(75) Inventors: Klaus Stutznäcker, Frechen (DE); Christian Sturm, Krefeld (DE)

(73) Assignee: Nahmaschinenf Abrik Emil Stutznacker GmbH & Co., Cologne (DE)

( * ) Notice: Subject to any disclaimer, the term of this patent is extended or adjusted under 35 U.S.C. 154(b) by 1035 days.

(21) Appl. No.: 11/788,417

(22) Filed: Apr. 19, 2007

(65) Prior Publication Data

US 2008/0011214 A1 Jan. 17, 2008

(30) Foreign Application Priority Data

Apr. 20, 2006 (DE) ..... 10 2006 018 299
May 19, 2006 (DE) ..... 10 2006 023 680

(51) Int. Cl.
*D05B 35/12* (2006.01)
*D05B 35/00* (2006.01)

(52) U.S. Cl. ..... 112/475.05

(58) Field of Classification Search ..... 112/117, 112/118, 470.03–470.05, 303, 304, 475.01–475.05, 112/475.08, 475.17, 122.1; 382/287, 306; 242/554.2; 235/454
See application file for complete search history.

(56) References Cited

U.S. PATENT DOCUMENTS

| | | | | |
|---|---|---|---|---|
| 2,250,768 | A * | 7/1941 | Kennedy et al. | 112/470.27 |
| 2,323,843 | A * | 7/1943 | Richter et al. | 156/358 |
| 2,536,153 | A * | 1/1951 | Bishop | 242/554.1 |
| 4,864,631 | A * | 9/1989 | Jensen | 382/317 |
| 5,518,329 | A * | 5/1996 | Beaudry | 400/621 |
| 6,201,256 | B1 * | 3/2001 | Kouchi et al. | 250/559.44 |
| 6,603,887 | B1 * | 8/2003 | Focke et al. | 382/287 |
| 6,796,254 | B2 | 9/2004 | Bondanza et al. | |
| 6,848,846 | B2 * | 2/2005 | Codos et al. | 400/323.1 |

FOREIGN PATENT DOCUMENTS

| | | | |
|---|---|---|---|
| DE | 3734660 | A1 | 4/1989 |
| DE | 8520285 | U1 | 1/1990 |
| DE | 4025103 | A1 | 2/1992 |
| DE | 10125108 | A1 | 10/2002 |
| DE | 10354348 | B4 | 12/2004 |

* cited by examiner

*Primary Examiner* — Ismael Izaguirre
(74) *Attorney, Agent, or Firm* — John Wilson Jones; Jones & Smith, LLP

(57) ABSTRACT

A method for producing multi-layered sewing products from a sewing material such that within the length of sewing material several sewing products are formed with at least one sewing product pattern; the length of sewing material being fed to a processing station for sewn material downstream of the sewing unit, in which the sewn length of sewing material is separated and cut to individual sewing products at least transversely to its conveying direction and wherein markers are applied to the length of sewing material which include information concerning the processing of the length of sewing material and which are read by a reading device.

20 Claims, 3 Drawing Sheets

METHOD FOR PRODUCING LARGE AREA SEWING PRODUCTS

Figure 1:
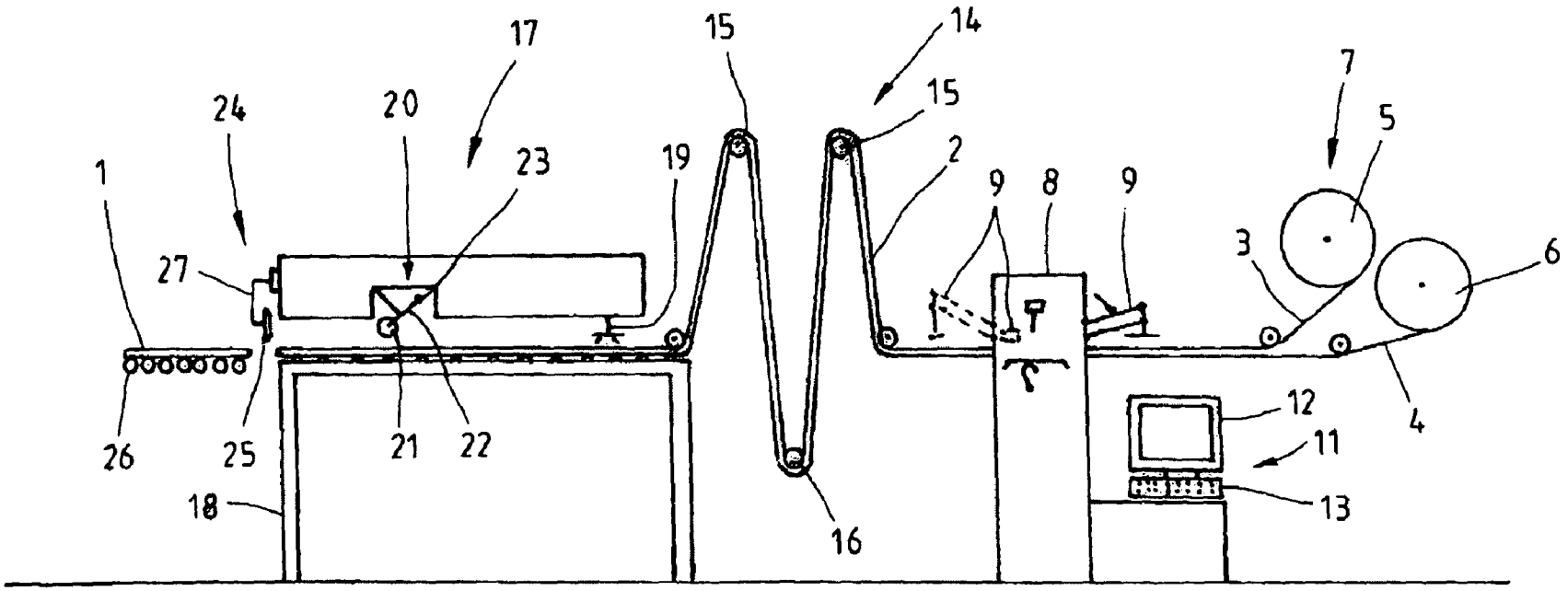

This invention relates to a method for producing plural large area sewing products, in particular multi-layered sewing products, for instance mattress sheets, from a preferably multi-layered length of sewing material that is fed to a sewing unit, for instance a multiple needle sewing unit and preferably a multiple needle chain stitch sewing machine in which the length of sewing material is sewn in such a way that within said length of sewing material several sewing products are each formed with a least one sewing product pattern, said length of sewing material being fed to a processing station for the sewn material downstream of the sewing unit, in which processing station the sewn length of sewing material is separated in and particularly cut to individual sewn products transversely with respect to its conveying direction, with markers being applied to the length of sewing material which carry information concerning the processing of the length of sewing material.

From prior art methods and devices for producing large sewing products and in particular multi-layered sewing products such as mattress sheets or quilts are known, DE 103 54 348 B1 discloses such a device which includes a multiple needle chain stitch sewing machine as a multiple needle sewing unit. Upstream of the multiple needle chain stitch sewing machine is connected a storage device for individual layers of sewing material which includes a conveyor belt which is arranged within a frame that is supported on rails which extend transversely to the conveying direction and which is movable transversely to the conveying direction of the conveyor belt along said rails, wherein the possible displacement is limited corresponding to the possible transverse displacement of a conveyor device, which last-mentioned conveyor device is a constituent part of the multiple needle chain stitch sewing machine. Through this conveyor device the sewing material to be sewn, which normally consists of several sewing material layers, is moved to and fro with respect to sewing members of the multiple needle chain stitch sewing machine, namely needles that are arranged on a needle bar and shuttles that are arranged on a hook shaft, in order to sew particular sewing product patterns in the length of sewing material.

Downstream of the multiple needle chain stitch sewing machine is connected a processing station which in the device according to DE 103 54 348 B4 is formed as a winding station where the finished sewn length of sewing material is rolled up.

A further multiple needle chain stitch sewing machine is known from DE 101 25 108 A1. In this pre-known multiple needle chain stitch sewing machine several sewing material layers are withdrawn from a sewing material layer storage device that is connected upstream of the multiple needle chain stitch sewing machine and are fed to the multiple needle chain stitch sewing machine, with the individual layers of the sewing material being stitched together to form a length of sewing material. From this document it is known that the multiple needle chain stitch sewing machine includes a guiding device for the sewing material to be sewn, and said guiding device is arranged within the region of the sewing members and is movable with respect to the sewing members in a direction substantially at right angles to the conveying direction of the sewing material. At the same time, the sewing material can be conveyed both in the conveying direction from the sewing material layers storage device and in the opposite direction, in order to be able to stitch a plurality of sewing product patterns.

The above-described sewing units are electronically controlled and they normally include a central control unit, for instance a computer including a plurality of data serving for controlling the sewing unit. With the sewing unit it is possible for example to stitch different sewing patterns in the length of the sewing material, wherein said length of sewing material comprises a number of sewing products arranged in the longitudinal direction one after another, for instance mattress sheets. The sewing products of the length of sewing material are usually cut in a downstream cutting device in the longitudinal direction of the length of sewing material and transversely to the longitudinal direction of the length of sewing material.

Since corresponding sewing units can accordingly sew and produce a variety of different sewing products, said sewing units include in the central control unit a programmable task management in which parameters of the individual sewing products to be made are input. These parameters are among others the dimensions of the sewing products to be made and to be finally separated from the length of sewing material as well as the sewing product patterns to be arranged in the sewing products.

To make a continuous operation of the sewing units possible it is necessary that different sewing products can be made without changing the sewing unit or processing stations connected downstream of the sewing unit. In this respect it turned out as advantageous to apply markers to the length of sewing material, in particular by printing, by which markers information concerning the processing of the length of sewing material is conveyed. U.S. Pat. No. 6,796,254 for instance discloses a method for sewing a length of sewing material, in which method a pattern is printed onto the length of sewing material. Furthermore, the length of sewing material is provided with markers conveying information about the length of sewing material and the sewing products to be made from it. The information contained are for instance material composition, order number, product type or the like in a machine-readable element which is directly or indirectly printed onto the length of sewing material for example in the form of a barcode. Additional markers may be provided for example in order to fix the number of products to be made.

The above-described devices have proven themselves as suitable for the production of large area and in particular multi-layered sewing products, especially mattress sheets. However, the pre-known method according to U.S. Pat. No. 6,796,254 lacks sufficient precision concerning the further processing of the length of sewing material, so that a faultless production is not guaranteed by this method. A disadvantage in this pre-known method particularly is that the lengths of sewing materials are prefabricated and thereafter are fed to the sewing unit. The prefabrication of a length of sewing material results in a high degree of inflexibility concerning the handling, since the sewing operation and the further processing steps cannot be changed within the prefabricated length of sewing material.

Basing on the above-described prior art, it is a problem of the present invention to improve a method of the type as described with regard to the flexibility and efficiency of processing of a length of sewing material.

In a method according to the present invention the solution of this problem provides that the markers are applied immediately before, after and/or during the sewing operation.

Further developments of the method provide that the markers are applied at a certain distance to a respective sewing material and are provided with a sign, for instance one digit at least, one character at least and/or one pictograph at least for the identification of a subsequent sewing material, wherein the marker with the sign is assigned features of the subsequent sewing material, and wherein the marker with the sign and the features is memorized in a control unit of the sewing unit for further processing of the sewing material.

Accordingly, this embodiment of the present invention provides that a marker is applied directly before or during the sewing operation at a certain distance to the respective sewing material and is provided with signs, for instance with one digit at least or one character at least and/or one pictograph at least allowing the identification of the respective sewing material. In this method, the sewing unit sews a particular sewing product pattern which is also assigned to a particular sewing product. The sewing products may be different from each other concerning their dimensions. The features which characterize the sewing product are assigned to the marker as an information, so that in the subsequent processing steps the respective sewing material can be identified through the marker and processed in a corresponding manner, for instance by performing particular cuts in the longitudinal direction and transversely to the longitudinal direction. To this end the marker may include various characters which make it possible to identify the respective sewing product. There can be provided for example digits or numbers combined from digits, characters and/or pictographs which allow an identification by means of a downstream reading device. Of course, it is also possible that the marker includes a barcode which is decoded by means of a barcode reader. Further options exist by providing a marker which can be magnetized or which has a particular colour.

In every case, however, a particular code of the marker has assigned to it a particular sewing product which is recognized and identified in the subsequent processing stations.

A further feature of the method according to the invention provides that the sewing product including particular features like the type and/or geometrical form of the sewing product pattern and/or the length and/or the width of the sewing product is encoded with at least one marker which is arranged in one of two at least and preferably four predetermined possible positions on the length of sewing material, wherein the number and the arrangement of the marker(s) is(are) read as an information in a reading device and transmitted to the sewing unit and/or the processing station connected downstream of the sewing unit, for instance a cutting station.

In this embodiment of the method according to the invention it is accordingly provided that particular positions are defined on the length of sewing material, which positions are provided for receiving one or several markers. The definition of the position is necessary because these positions have to be matched with the reading device. Normally it is sufficient to fix four positions which serve for receiving markers, so that a plurality of different sewing products can be identified through the reading device. By these markers the type and/or geometrical form of the sewing product can be predetermined if the markers are applied to the length of sewing material already before and particularly directly before the sewing unit, so that through the identification of the sewing product within the length of sewing material also the sewing unit is controllable which produces a particular sewing product pattern in the length of sewing material for forming the sewing product. But normally these markers are used for controlling a cutting device. To this end it may be expedient to apply the markers to the length of sewing material in the particular positions only after the sewing unit, in order to thereafter feed the length of sewing material to a reading device in which the encoded markers that are arranged are decoded and the sewing material which is identified through this process is cut corresponding to the predetermined parameters. Of course, it is possible to use a larger number of positions in case of a larger number of different sewing products to be made.

According to a further development of the invention it is provided that at least one marker for controlling a cutting device for cutting the length of sewing material in its longitudinal direction is applied to the length of sewing material in a position preceding a cutting area, in dependence of the cutting area, wherein the marker is read by a reading device and the cutting device is moved to the cutting area relative to the width of the length of sewing material.

Accordingly, this further development of the method according to the present invention provides that at least one marker for controlling a cutting device cutting the length of sewing material in its longitudinal direction is applied to the length of sewing material preferably in a position preceding the cutting area. By this marker the cutting device is controlled in such a manner that for instance the cutting line is predetermined by the marker. By the reading device the arrangement of the marker is detected. The cutting device may include one or several cutting blades or the like which are movable at right angles to the longitudinal extension of the length of sewing material and which are controlled by the marker and the reading device in their positions relative to the length of sewing material. It is also conceivable for the cutting device to include one fixed cutting blade and one or more movable cutting blades. This embodiment requires that the sewing products within the length of sewing material are identically oriented with a cutting area extending in the longitudinal direction.

The marker and normally at least two markers can be additionally used for cutting the length of the sewing material transversely to the longitudinal extension thereof. To this end the markers can be arranged on a line which defines the cutting line transversely to the longitudinal extension of the length of sewing material.

Further features and advantages of the method according to the invention will become apparent from the subclaims and the following discussion.

According to a further development of the first embodiment of the method it is provided that at least one marker for controlling a cutting device cutting the length of sewing material in the longitudinal direction thereof is applied to the length of sewing material preferably in a position preceding a cutting area, in dependence of the cutting area, wherein the marker is read by a reading device and the cutting device is moved to the cutting area transversely to the feeding direction of the length of sewing material. In this construction the two embodiments of the above-described methods are combined, so that the marker or the markers are used not only for identifying the sewing material within the length of sewing material but also for controlling a cutting device for performing a cutting operation in the feeding direction of the length of sewing material. Therefore, at least one predetermined position for arranging the marker is set in a cutting area of the cutting device.

The marker(s) is(are) preferably detachably fixed to the lengths of sewing material. It turned out as advantageous to adhesively bond the markers to the length of sewing material, because adhesive bonding provides for a sufficient adherence of the markers to the length of sewing material, and after the sewing product is finished the markers can be removed again from the sewn product substantially without leaving residues.

Preferably, the markers are formed to be machine-readable, so that they can be easily recognized and read by usual reading devices. To this end the markers may have ferromagnetic properties, so that they can be read by a reading device in the form of a magnetic reader. Alternatively or in addition the markers may be provided in colour, so that a colour detecting device can be used as a reading device.

According to a further feature of the invention it is provided that at least one marker is used for a transverse cut of the length of sewing material, in particular at right angles to the longitudinal extension thereof. An advantage of this construction is that the marker can be used in a simple way for a transverse cut, in particular at right angles to the longitudinal extension of the length of sewing material and that the marker can be simultaneously read while passing through the reading device, provided that the reading device is oriented as usual parallel to the cutting direction and in particular at right angles to the longitudinal direction of the length of sewing material.

A further development of the method according to the invention provides that the marker or markers includes or include machine-readable information which is transmitted to a central control unit and which is assigned therein to the product-related data memorized in the control unit that controls the sewing unit and/or the downstream processing station in dependence of the information of the marker or markers.

Accordingly, it is possible through a variety of information to utilize the markers as a control element for a plurality of processing steps in the manufacture of the sewing product. Consequently, the markers can be used not only for the identification of the sewing material but also for controlling the sewing unit for sewing a particular sewing product pattern. Preferably, the corresponding information is assigned to product-related data memorized in the control unit, so that through the markers particular steps of the process like for instance the flow of manufacturing operations, in particular sewing operations, can be controlled in a simple way. Corresponding lengths of sewing material can therefore be already prepared according to the requirements of the customers and can be placed in the storage device of the sewing unit, so that the markers are already arranged on the prepared lengths of sewing material and need not be applied to the same immediately before the sewing unit.

The markers can be used both for cuts in the longitudinal direction of the length of sewing material and for cuts transversely to the longitudinal direction of the length of sewing material.

Finally, according to a further feature of the invention it is provided that the marker(s) is(are) arranged on the length of sewing material before entering in the sewing unit.

Figure 2:
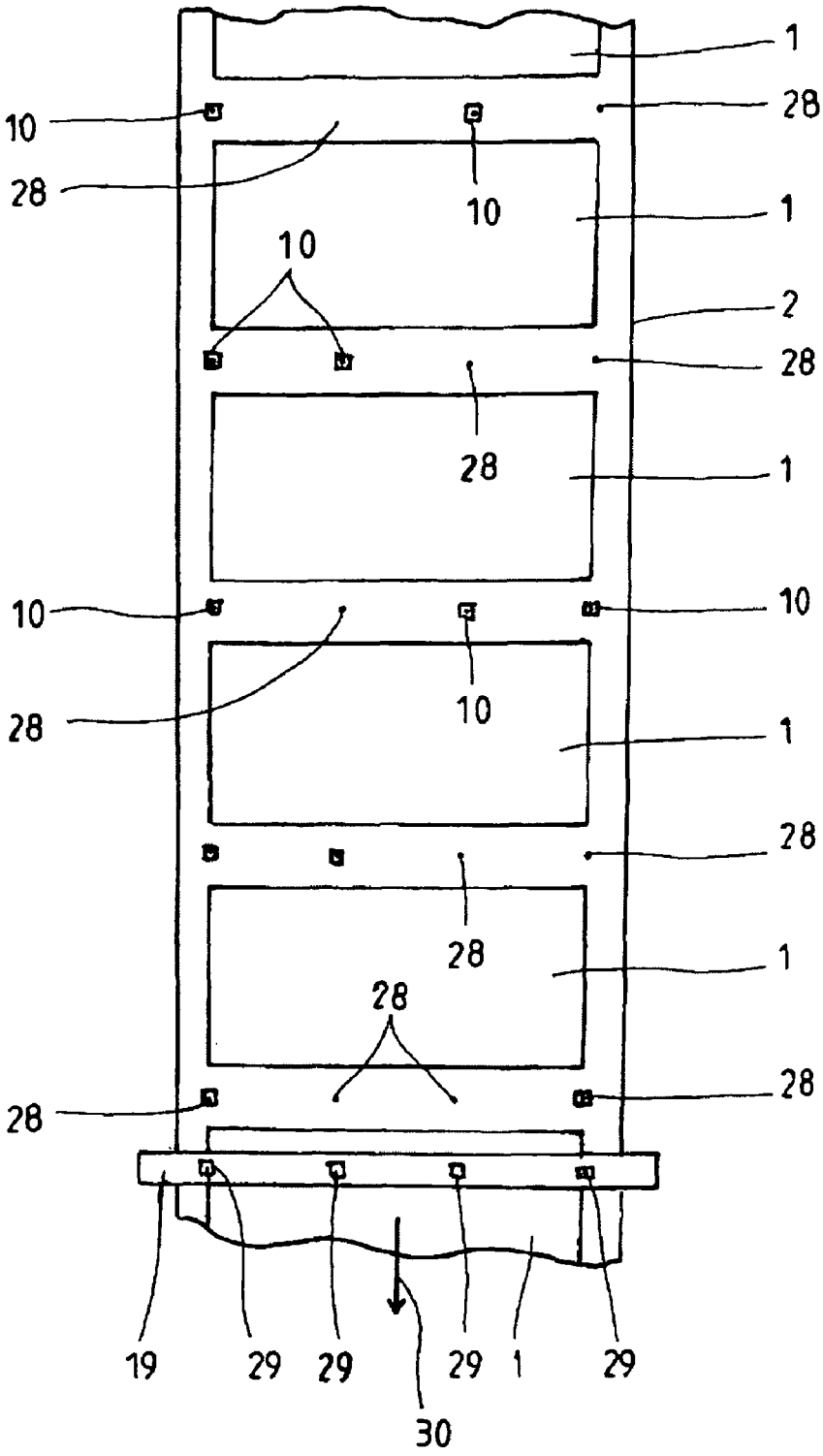
Figure 3:
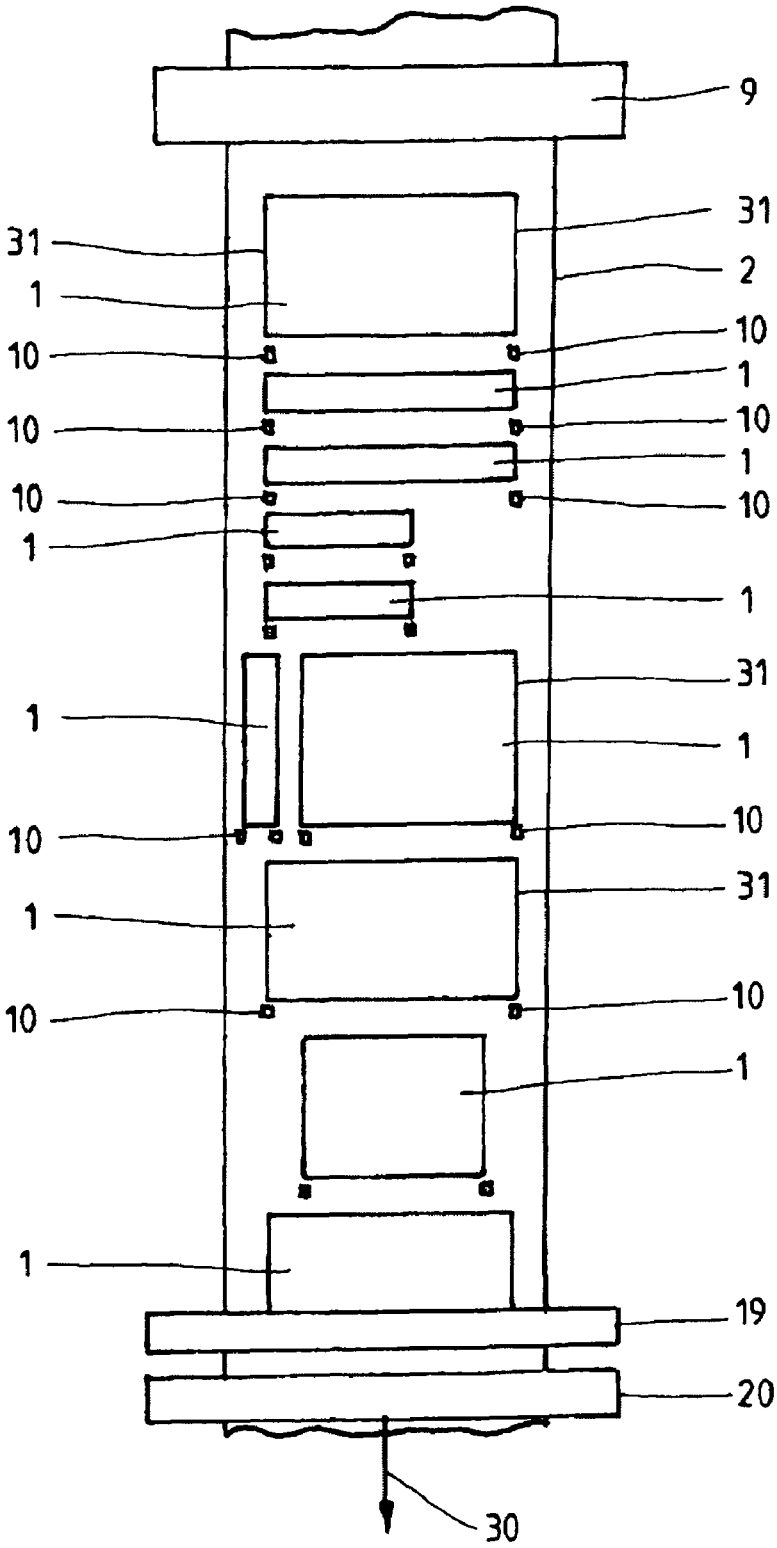

From the following description of the drawing further features and advantages will become apparent. In the drawing it is shown by:

FIG. 1 a device for manufacturing large area sewing products in a schematic lateral view;

FIG. 2 a length of sewing material with several sewing products in a top view;

FIG. 3 a further length of sewing material with several sewing products in a top view.

In FIG. 1 a device for manufacturing large area sewing products 1 from a multi-layered length of sewing material 2 is shown. Such a sewing product 1 can be a mattress sheet for instance which serves for manufacturing customary mattresses, wherein the mattress sheet may serve both for forming a large surface of the mattress and for forming a lateral surface of the mattress.

The length of sewing material 2 consists of two sewing material layers 3, 4 which are kept at stock in the form of rolls 5, 6 in a storage device 7. The sewing material layers 3, 4 are withdrawn from the rolls 5, 6 and are supplied to a sewing unit 8. The sewing unit 8 can be formed for instance as a multiple needle chain stitch sewing machine and accordingly includes a plurality of needles arranged on a needle bar above a sewing material support. Below the sewing material support (not further shown) of the multiple needle chain stitch sewing machine a number of shuttles which at least corresponds to the number of needles are arranged on a hook shaft.

FIG. 1 additionally shows a marking device 9 connected immediately upstream of the sewing unit 8, by which marking device 9 markers 10 that can be seen in the FIGS. 2 and 3 are detachably applied to the length of sewing material 2. The configuration and function of the markers 10 will be discussed in more detail below. Alternatively, the marking device 9 can be arranged in the sewing unit 8 or can be disposed immediately downstream of the sewing unit 1 as it is shown by the dashed line in FIG. 1. Furthermore, marking devices 9 can be provided directly before, after and in the sewing unit 8.

The sewing unit 8 is formed with a central control unit 11 which among others includes a monitor 12 and a keyboard 13.

In the sewing unit 8 the two layers of sewing material 3, 4 are stitched together and are fed to a storage device 14 which includes two upper guide pulleys 15 and an intermediate dancing roller 16. The storage device 14 receives the stitched length of sewing material 2 and compensates differing processing speeds of the sewing unit 8 and of processing station 17 connected downstream of the storage device 14.

The processing station 17 includes a conveyor table 18 for the length of sewing material 2. Above the conveyor table 18 a reading device 19 is arranged which reads the markers 10 applied to the length of sewing material 2 by means of the marking device 9. In dependence of the markers 10 the reading device 19 may be provided as a magnetic reader or as a colour detector. Of course, also other reading devices such as a barcode reader or the like are conceivable.

Downstream of the reading device 19 a first cutting device 20 is arranged which consists of one cutting blade 21 at least that is aligned in parallel with the longitudinal extension of the length of sewing material 2, so that the length of sewing material 2 can be cut with the cutting blade 21 in the longitudinal direction. The cutting blade 21 is arranged on a swivel arm 22 and can be pivoted about a fulcrum 23, so that the cutting blade 21 in its disengaged position shown in FIG. 1 can be pivoted to a position in which the cutting blade 21 cuts into the length of sewing material 2. The cutting device 20 is movable transversely with respect to the longitudinal direction of the length of sewing material 2, so that the cutting blade 21 is movable to different cutting positions for performing a plurality of cuts parallel to the longitudinal axis of the length of sewing material 2.

A further cutting device 24 is provided on the end of the processing station 17 and again includes one cutting blade 25 at least which is aligned transversely to the longitudinal extension of the length of sewing material 2, in order to cut the length of sewing material 2 to individual sewing products 1 at the end of the processing station 17, which sewing products 1 are transferred over a roller conveyor 26.

The cutting blade 25 is arranged on a swivel arm 27 which allows the cutting blade 25 to be lowered from the disengaged position shown in FIG. 1 to an engaged position in which the cutting blade cuts into the length of sewing material 2. Corresponding to the cutting device 20 also the cutting device 24 is movable transversely to the longitudinal extension of the length of sewing material 2, in order to be able to cut the entire length of sewing material 2.

FIG. 2 shows the length of sewing material 2 with several sewing products 1 of a different design. In FIG. 2 the sewing products 1 have corresponding shapes and dimensions but are different from each other by a sewing product pattern (not further shown) which is stitched into the sewing products 1.

On the length of sewing material 2 predetermined positions 28 are provided which are arranged both in the longitudinal direction and transversely to the longitudinal direction of the length of sewing material 2 on lines intersecting at right angles.

To these positions 28 markers 10 are partially adhesively bonded which serve for identifying the different sewing products 1. To this end the reading device 19 which extends in a beam-like fashion over the length of sewing material 2 is provided which includes reading heads 29, for instance magnetic readers, in a number corresponding to the maximum number of positions 28 provided in a line transversely to the longitudinal extension of the length of sewing material 2.

The markers 10 consist of a metallized foil having ferromagnetic properties.

When the length of sewing material 2 is conveyed in a direction of arrow 30 the markers 10 under the reading device 19 are conveyed and detected by the reading heads 29. The different arrangement of the markers 10 serves for identifying the subsequent sewing product 1, so that for instance in FIG. 2 corresponding cuts are performed in subsequent cutting devices 20 or 24 (not further shown), by which the sewing products 1 are separated from the length of sewing material 2.

In a similar way it is possible through the above-described arrangement of a length of sewing material 2 with markers 10 detachably applied to it to control also the sewing unit 8 in such a manner that corresponding to the identified sewing product 1 a predetermined sewing product pattern is stitched into the sewing product 1.

Besides of the illustrated embodiment with four positions 28 for each subsequent sewing product 1 it is of course also possible to provide five, six or more positions 28 for identifying a corresponding sewing product 1. The number of positions is finally dependent of the number of different sewing products 1 to be made in a device according to FIG. 1.

A further embodiment of a length of sewing material 2 with different sewing products 1 is shown in FIG. 3. The length of sewing material 2 according to FIG. 3 is conveyed in the direction of arrow 30 and is moved under the marking device 9 in which markers 10 are adhesively bonded to the length of sewing material 2. For each sewing product 1 markers are adhesively bonded to the length of sewing material 2 in the region of extended cutting lines 31 running in the conveying direction, so that the spacing of the markers 10 of a sewing product 1 transversely to the longitudinal extension of the length of sewing material 2 corresponds to the spacing of two cutting lines 31. The markers 10 assigned to a sewing product 1 are arranged before the sewing product 1 in the conveying direction according to arrow 30.

According to FIG. 3 it can be seen that the sewing products 1 of the length of sewing material 2 are formed differently from each other both regarding their dimension and their orientation. Therefore, supplementary markers 10 can be provided for each sewing product 1 in the region of the cutting lines 31, which markers include as an information the end of a cut.

The length of sewing material 2 is passed through under the reading device 19 which detects the arrangement of the markers 10 and controls the cutting device 20 with cutting blades 21 (not further shown in FIG. 3) which are movable transversely to the longitudinal direction of the length of sewing material 2, so that the cutting blades 21 (FIG. 1) which are not further shown cut into the length of sewing material 2 along the cutting lines 31, corresponding to the arrangement of the markers 10. Supplementary, there can be of course provided the cutting device 24 shown in FIG. 1, by which the sewing products 1 are cut transversely to the longitudinal direction of the length of sewing material 2.

The markers 10 can further include additional information for instance about the length of the cutting lines 31, so that through this information cuts are performed precisely in the required length also without any additional markers 10 that indicate the end of a cutting line 31.

The invention claimed is:

1. A method for producing several large area and multi-layered sewing products, from a multi-layered length of sewing material which is fed to a sewing unit, comprising:

(a) sewing the length of sewing material in such a manner that several sewing products with at least one respective sewing product pattern are formed within the length of sewing material, wherein the length of sewing material is fed to a processing station for sewn material downstream of the sewing unit, in which processing station the sewn length of sewing material is separated to individual sewing products at least transversely to its feeding direction;

(b) applying markers to the length of sewing material which include information concerning the processing of the length of sewing material and which are read by a reading device, wherein the markers are applied immediately before, after and/or during sewing.

2. The method according to claim 1, further comprising:

applying the markers at a certain distance to a respective and/or to be processed sewing product; and providing the markers with information, allowing the identification of the respective and/or to be processed sewing product.

3. The method according to claim 2, further comprising:

assigning the marker with the information of features of the subsequent sewing product; and memorizing the features in a control unit of the sewing unit for further processing of the sewing product.

4. The method according to claim 1, further comprising:

including the step of encoding the sewing product including particular features selected from the type and/or geometrical form of the sewing product pattern and/or the length and/or the width with one marker at least which is arranged in one of at least two possible positions on the length of sewing material, wherein the number and the arrangement of the marker or markers arranged on the positions are read as an information in a reading device and are transmitted to the sewing unit and/or to the processing station, connected downstream of the sewing unit.

5. The method according to claim 1, further comprising:

applying at least one marker for controlling a cutting device cutting the length of sewing material in its longitudinal direction to the length of sewing material, in dependence of the cutting area;

reading the marker by a reading device; and moving the cutting device to the cutting area relative to the width of the length of sewing material.

6. The method according to claim 1, further comprising the step of applying the marker or the markers detachably to the length of sewing material.

7. The method according to claim 1, including the step of forming the marker or markers machine-readable.

8. The method according to claim 1, including the step of using a marker for a cut of the length of sewing material transversely to the conveying direction of the length of sewing material.

9. The method according to claim 1, including the step of arranging markers at least in one row adjacent to each other and/or behind each other.

10. The method according to claim 1, characterized in that the marker or markers is or are formed colored and that the reading device includes a color detector.

11. The method according to claim 1, characterized in that the marker or markers is or are formed with ferromagnetic properties and that the reading device includes a magnetic reader.

12. The method according to claim 1, including the steps of transmitting machine-readable information included in the marker to a central control unit; and assigning to the machine-readable information product-related data memorized in the control unit which data control the sewing unit and/or the processing station downstream of the sewing unit.

13. The method according to claim 1, including the step of controlling both cuts in the longitudinal direction of the length of sewing material and cuts transversely to the longitudinal direction of the length of sewing material through the marker or markers.

14. The method according to claim 1, including the step of arranging the marker or markers on the length of the sewing material before entering in the sewing unit.

15. The method according to claim 1, including the step of controlling the sewing unit and/or the processing station downstream of the sewing unit through the marker or markers including machine-readable information.

16. The method according to claim 1, characterized in that the multi-layered sewing products, are mattress sheets.

17. The method according to claim 1, characterized in that the sewing unit is a multiple needle sewing unit.

18. The method according to claim 17, characterized in that the multiple needle sewing unit is a multiple needle chain stitch sewing machine.

19. The method according to claim 2, wherein the markers have information of at least one digit, at least one character and/or at least one pictograph.

20. The method according to claim 5, wherein the least one marker is applied to the length of sewing material in a position preceding the cutting area.

* * * * *